US007891804B2

(12) United States Patent
Taguchi et al.

(10) Patent No.: US 7,891,804 B2
(45) Date of Patent: Feb. 22, 2011

(54) RECORDING APPARATUS

(75) Inventors: Motoyuki Taguchi, Kawasaki (JP); Hiroyuki Saito, Yokohama (JP); Nozomu Nishiberi, Yokohama (JP); Koya Iwakura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 585 days.

(21) Appl. No.: 11/139,767

(22) Filed: May 27, 2005

(65) Prior Publication Data

US 2005/0270354 A1 Dec. 8, 2005

(30) Foreign Application Priority Data

May 28, 2004 (JP) ..... 2004-159661

(51) Int. Cl.
*B41J 2/01* (2006.01)

(52) U.S. Cl. ..... 347/104; 346/139 R; 347/103; 399/124; 399/364; 399/401; 358/474; 358/496

(58) Field of Classification Search ..... None
See application file for complete search history.

(56) References Cited

U.S. PATENT DOCUMENTS 5,155,540 A * 10/1992 Yamada et al. ..... 399/402
5,418,607 A * 5/1995 Tani ..... 399/364
5,513,840 A * 5/1996 Fujita et al. ..... 271/301
6,571,074 B2 * 5/2003 Suzuki et al. ..... 399/124
6,836,642 B2 * 12/2004 Miyake ..... 399/401
7,581,729 B2 * 9/2009 Fujita et al. ..... 271/248
2002/0057322 A1 * 5/2002 Tanikawa et al. ..... 347/103
2003/0038989 A1 * 2/2003 Yokota et al. ..... 358/474
2005/0025511 A1 * 2/2005 Watabe ..... 399/67
2005/0129439 A1 * 6/2005 Asano ..... 399/401
2007/0019252 A1 1/2007 Ogushi et al.

FOREIGN PATENT DOCUMENTS

JP 2000-219365 8/2000

* cited by examiner

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

A recording apparatus includes a recording portion for recording an image on a recording sheet; feeding means for feeding the recording sheet through the recording portion, wherein in a both-side recording operation, a sheet inclination rectifying operation in a recording sheet feeding direction is carried out when the recording is effected on a first side of the recording sheet, and the sheet inclination rectifying operation is not carried out when the recording is effected on a second side of the recording sheet.

10 Claims, 6 Drawing Sheets

RECORDING APPARATUS

FIELD OF THE INVENTION AND RELATED ART

The present invention relates to a recording apparatus which records by a recording means, on a sheet of recording medium conveyed by a conveying means.

As an output for various information processing apparatuses inclusive of a personal computer, a recording apparatus, such as a printer, an image forming apparatus, a facsimile machine, a copying machine, etc., is in use, which records on a sheet of recording medium (which hereinafter will be referred to as recording sheet) as an object on which recording is to be made, with the use of a recording means, based on recording data. Recording apparatuses can be classified into the thermal transfer group, ink jet group, laser group, wire dot group, etc. Recording apparatuses are structured so that recording is made on a recording sheet while the recording sheet is conveyed by a mechanical portion for conveying the recording sheet. As for the recording methods used by recording apparatuses, there are the recording methods of the serial type and line type. In the serial type, both a recording means and a recording sheet are moved to form an image on the recording sheet; the recording means is moved in a manner of scanning the recording sheet in the direction (primary direction) intersectional to the recording sheet conveyance direction while the recording sheet is conveyed. In the line type, in order to form an image on a recording sheet, only the recording sheet is moved; a recording means is kept stationary while the recording sheet is conveyed. In other words, the recording sheet is scanned (in relative terms) by the recording means only in the secondary direction.

In recent years, digital cameras have come to be widely used, and with the growth in the usage of digital cameras, it has become a common practice to record photographic images with the use of a printer, a copying machine, or the like. Consequently, it has become a common practice to use as recording medium, various sheets different in structure and material, for example, a recording sheet coated to yield a desirable photographic image. Some of the image forming apparatuses such as the abovementioned printer are capable of recording on both surfaces (top and bottom sides) of a recording sheet. Moreover, in recent years, recording apparatuses capable of recording multicolor images, as well as monochromatic images, on a coated recording sheet, have become available. Some of the recording apparatuses, which record an image on a recording sheet while the recording sheet is moved through the recording area by a recording medium conveyance roller, are structured so that after the recording sheet is fed from the sheet feeding portion into the sheet conveying portion, a sequence for correcting in attitude a skewed recording sheet by causing the leading end of the recording sheet to run into the nip between the conveyance roller and pinch roller, which are being kept stationary, is carried out in order to accurately control a sheet recording medium in terms of the attitude and position relative to the recording area, as disclosed in Japanese Laid-open Patent Application 2000-219365.

The above described sequence for correcting a skewed recording sheet in attitude is carried out to utilize the resiliency of the recording sheet to control the recording sheet in the position of its leading end, and also, in attitude, by jogging the recording sheet so that the leading end of the recording sheet is pushed against the nip between the pair of rollers (driver roller and follower roller), which are being kept stationary.

However, a recording apparatus structured so that when it is in the two-sided recording mode, it carries out the above described sequence for correcting the recording sheet in attitude both when it records on the first surface of a recording sheet and when it records on the second surface, suffers from the following problem. That is, while the recording sheet is conveyed through the U-turn path, or the like, of the recording apparatus in order to record on the opposite surface (second surface) of the recording sheet from the surface (first surface) on which recording has just been made, the rollers in the U-turn path, or the like, sometimes spin in contact with the first surface, leaving spin marks on the image which has just been formed on the first surface, reducing thereby the image on the first surface in quality. This type of roller mark is likely to occur when the recording apparatus is in the two-sided mode, in particular, when a coated recording sheet is used as the recording medium, and recording is first made on the coated surface thereof. More specifically, while a recording sheet, across the coated surface of which recording has just been made, is conveyed through the U-turn path, the conveyance rollers in the U-turn path come in contact with the recorded surface (first surface), which is wet and swollen because of the formation of an image thereon. Therefore, the conveyance rollers in contact with the first surface of the recording sheet are likely to spin, and the spinning of the conveyance rollers is likely to leave roller marks, reducing thereby the level of image quality achievable by the image forming apparatus, and also, reducing the image forming apparatus in reliability.

SUMMARY OF THE INVENTION

The present invention was made in consideration of the above described problems. Thus, its primary object is to provide a recording apparatus which is capable of conveying a sheet of recording medium at a high level of accuracy, and does not leave roller marks on the recording medium, even when it is in the two-sided recording mode.

The present invention for achieving the above object is characterized in that a recording apparatus comprising a recording portion for recording an image on a recording sheet, and a conveying means for conveying a recording sheet through the recording portion, is structured so that when an image is formed on the first surface of a recording sheet, the sequence for correcting a recording sheet in attitude is carried out, whereas when an image is formed on the second surface of the recording sheet, that is, the surface opposite to the first surface, the sequence is not carried out.

According to the present invention, when an image is formed on the first surface of a recording sheet by a recording apparatus which is in the two-sided recording mode, the sequence for correcting a skewed recording sheet by jogging the recording sheet so that the leading end of the recording sheet, in terms of the recording sheet conveyance direction, is pushed against the conveyance roller and pinch roller, is carried out, whereas when an image is formed on the second surface of the recording sheet, that is, the surface opposite to the first surface, the sequence for correcting a skewed recording sheet is not carried out. Therefore, even when recording on both surfaces of such a recording sheet as a coated sheet that is likely to sustain roller marks, the recorded surface of the recording sheet will not going to sustain the roller marks, and should it sustain the roller marks, the amount of the roller marks will be minimal.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 6 is a flowchart of the control of the recording apparatus shown in

FIG. 1.

DESCRIPTION OF THE PREFERRED EMBODIMENTS

Hereinafter, one of the preferred embodiments of the present invention will be described in detail with the reference to the appended drawings. Throughout the drawings, the same referential symbols designate the same or corresponding components or the portions thereof.

Figure 1:
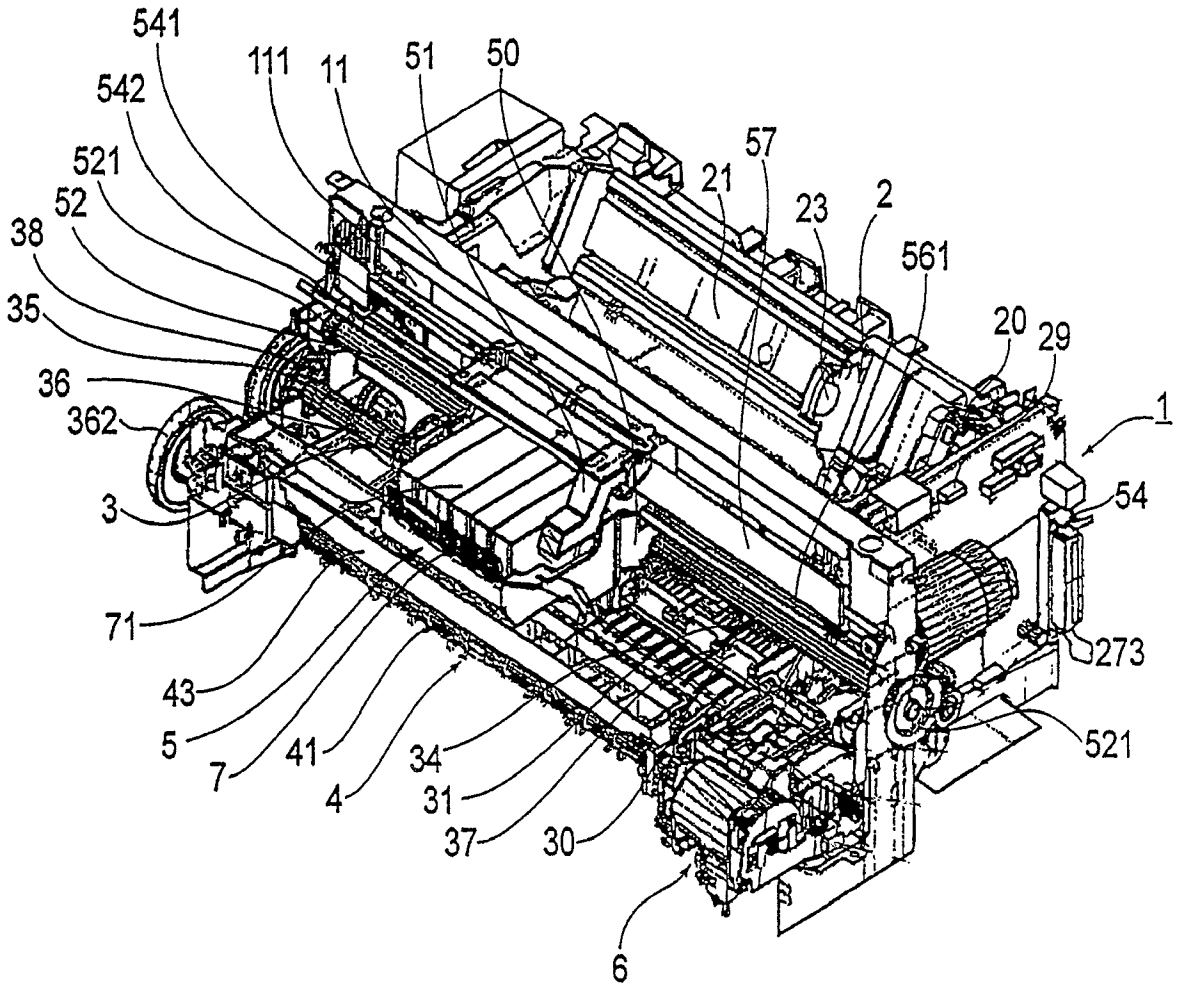
FIG. 1 is a schematic perspective view of the recording apparatus in one of the preferred embodiments of the present invention, as seen from the right-front side of the apparatus, showing the mechanical structure thereof.
Figure 2:
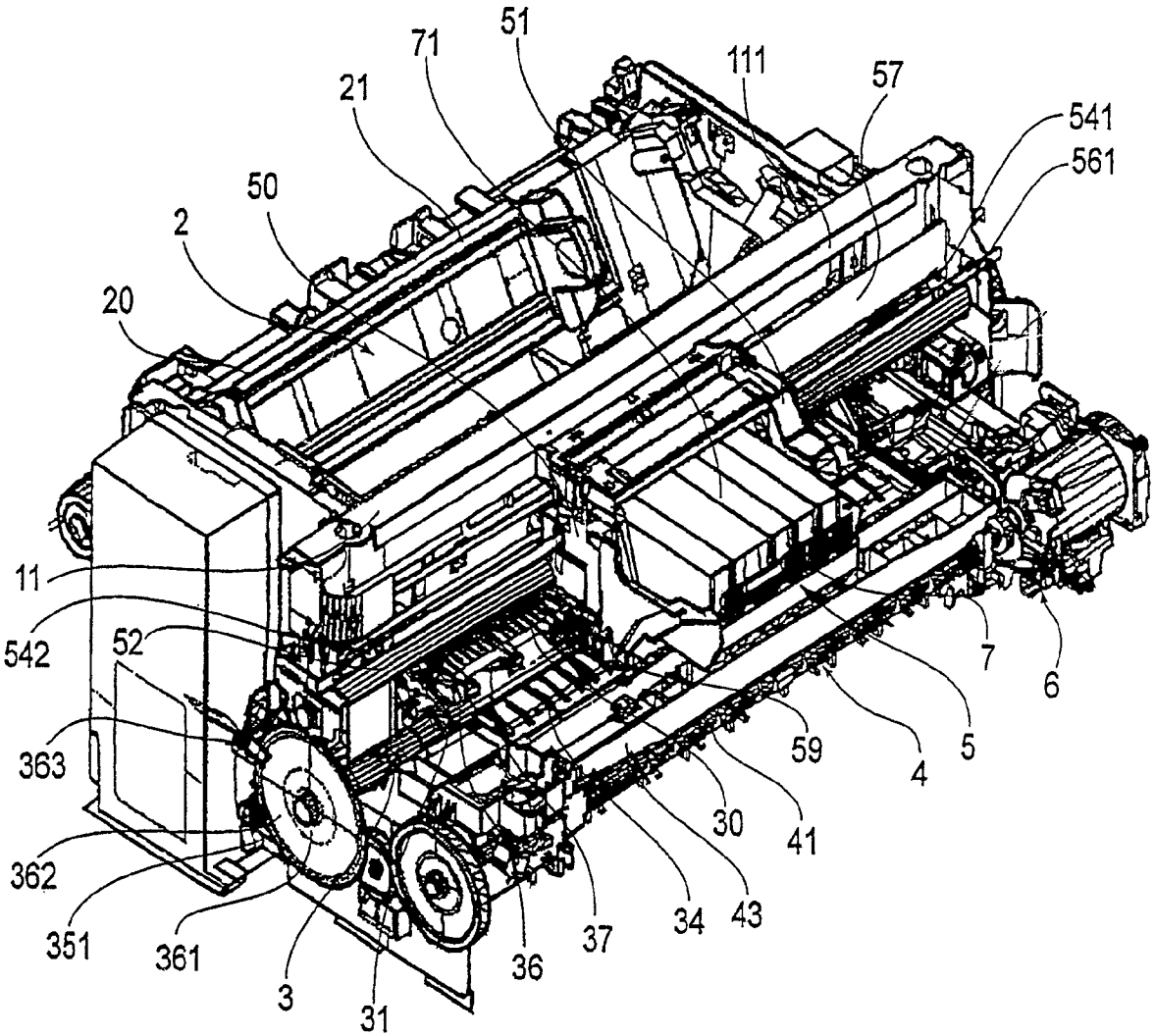
FIG. 2 is a schematic perspective view of the recording apparatus shown in FIG. 1, as seen from the left-front side of the apparatus, showing the mechanical structure thereof.
Figure 3:
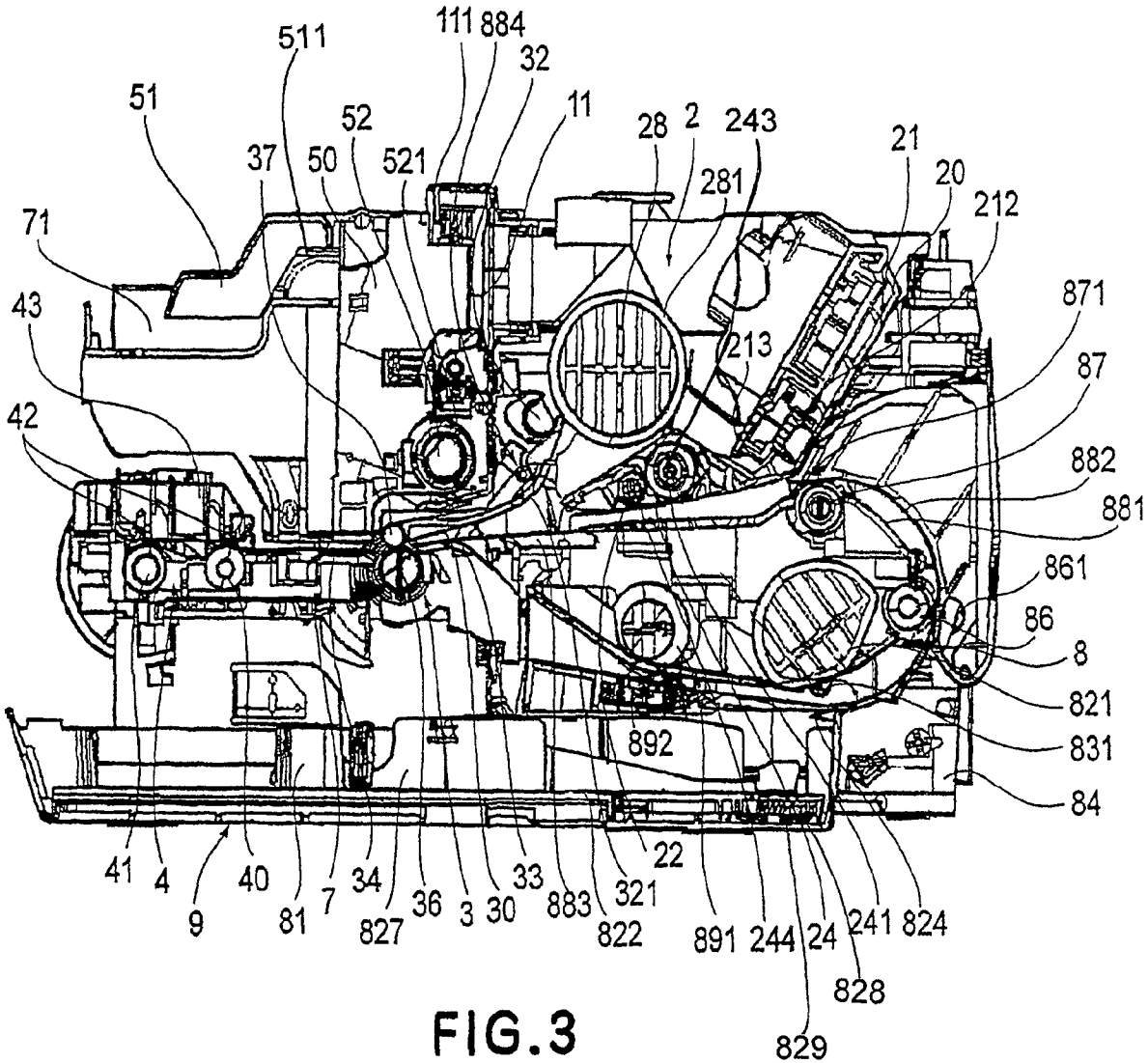
FIG. 3 is a schematic vertical sectional view of the recording apparatus shown in FIG. 1.
Figure 4:
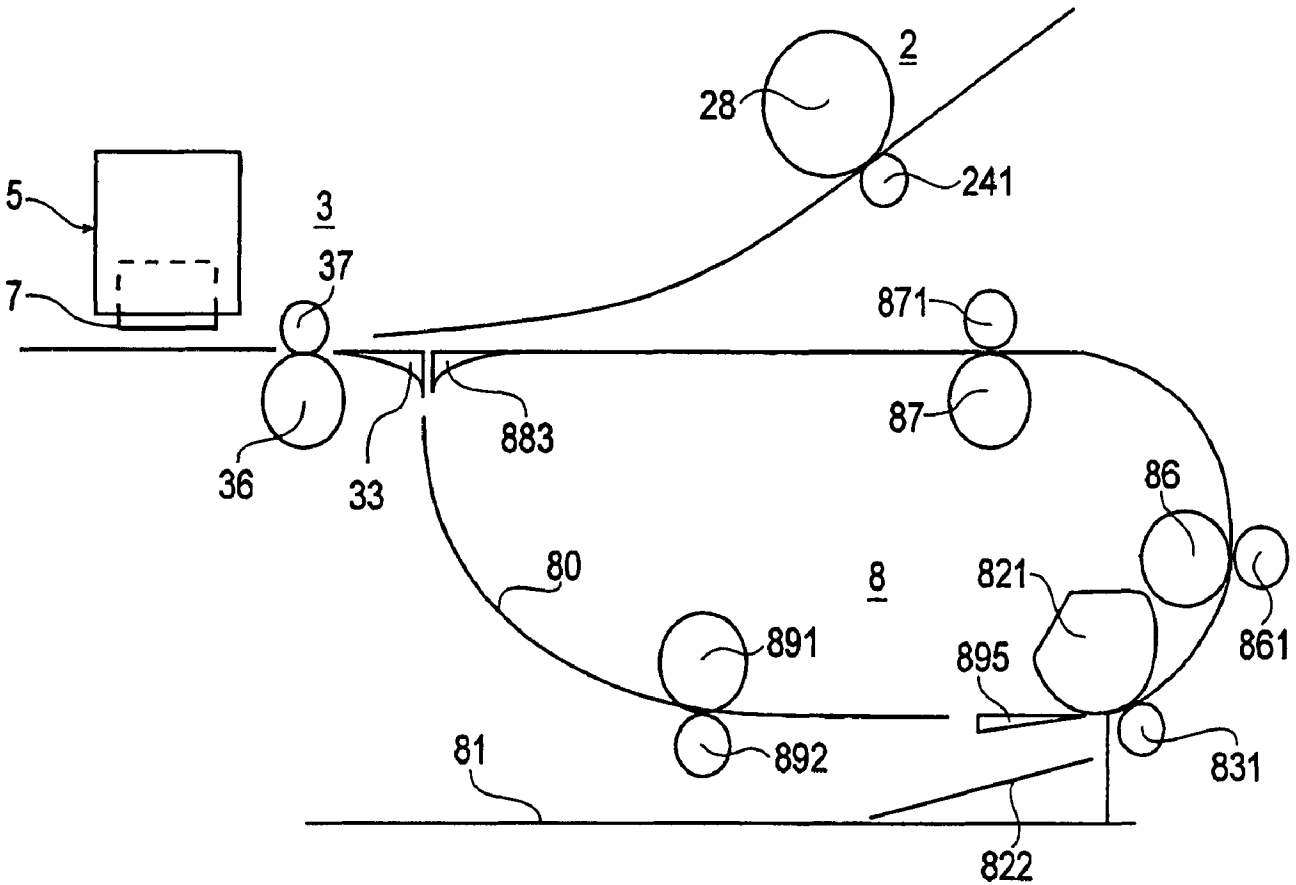
FIG. 4 is a schematic side view of the recording sheet conveying mechanism of the recording apparatus shown in FIG. 1, showing the general structure thereof.

FIG. 1 is a schematic perspective view of the recording apparatus 1 in one of the preferred embodiments of the present invention, as seen from the right-front side of the apparatus, showing the mechanical structure thereof, and FIG. 2 is a schematic perspective view of the same recording apparatus as the one shown in FIG. 1, as seen from the left-front side of the apparatus, showing the mechanical structure thereof. FIG. 3 is a schematic vertical sectional view of the same recording apparatus as the one shown in FIG. 1, and FIG. 4 is a schematic side view of the recording medium conveying mechanism of the same recording apparatus as the one in FIG. 1, showing the general structure thereof. Referring to FIGS. 1-3, the recording apparatus comprises a sheet feeding portion 2, a sheet conveying portion 3, a sheet discharging portion 4, a recording portion 5 (carriage portion), a sheet turning portion 8 (comprising U-turn path), and a recovery unit 6. Next, these structural portions will be individually described. Incidentally, the recording apparatus in this embodiment is an ink jet recording apparatus.

Sheet Feeding Portion 2: The sheet feeding portion 2 comprises: a pressure plate 21 against which a plurality of recording sheets, as recordable mediums, are mounted in layers; a sheet feeding roller 28 (which hereinafter will be referred to as feed roller) for feeding recording sheets into the main assembly of the recording apparatus; a separation roller 241 for separating one of the plurality of recording sheets from the rest; a return lever 22 for returning the rest of the recording sheets to the designated standby position; etc., which are attached to a base 20. The recording apparatus is provided with a sheet feeder tray for holding the mounted recording sheets, which is attached to the base 20, or the housing of the apparatus. The sheet feeder tray is of the collapsible multistage type, comprising a plurality of sections, which is to be pulled out for usage. The sheet feeding roller 28, or feed roller, is in the form of a rod, which is roughly semicircular in cross section. The feed roller 28 is provided with a separation roller 281, which is formed of rubber and is fitted around the feed roller 28 so that it is positioned near the recording sheet alignment reference, and by which recording sheets are conveyed. The force for driving the feed roller 28 is transmitted from an AP motor 273 of the sheet feeding portion 2, through a driving force transmission gear and a planetary gear. The AP motor 273 is shared by the feed roller 28, and a recovery unit portion 6 for maintaining and recovering the recording means 7 (recording head) in ink ejection performance.

The pressure plate 21 is provided with a movable side cover 23, which regulates the recording sheets in their positions relative to the main assembly of the recording apparatus. The pressure plate 21 is pivotable about a shaft attached to the base 20, and is kept pressured against the feed roller 28 by a pressure plate spring 212. Further, the pressure plate 21 is provided with a separation sheet, which is attached to the area of the pressure plate 21, which opposes the feeder roller 28, in order to prevent the plurality of sheets in the immediate adjacencies of the pressure plate 21 from being conveyed together. The separation sheet is formed of a material, such as a artificial leather, which is substantial in friction coefficient. The pressure plate 21 is moved toward, or away from, the feed roller (recording sheets), by a pressure plate cam.

To the base 20, a separation roller holder 24 for holding the separation roller 241 for separating the recording sheets one by one is attached, being thereby supported so that it is allowed to rotate about the rotational shaft attached to the base 20. The separation roller 241 is kept pressured against the feed roller 28 (recording sheets) by the separation roller spring 242. The separation roller 241 is provided with a spring clutch 243, which allows the separation roller 241 to rotate as the amount of the load which applies to the separation roller 241 exceeds a predetermined value. The separation roller 241 is moved toward, or away from, the feed roller 28 by the combination of a separation roller release shaft 244 and a control cam. The positions of the pressure plate 21, return lever 22, separation roller 241, etc., are detected by an ASF sensor 29.

The return lever 22 for returning the recording sheets to their designated standby positions is rotatably attached to the base 20, and is kept pressured by a return lever spring 221 toward the direction in which the lever 22 is released. The return lever 22 returns the recording sheets by being pivoted by the control cam. When the recording apparatus is on standby, the pressure plate 21 is kept in the position in which it does not pressure the recording sheets, by the pressure plate cam, whereas the separation roller 241 is kept in the position, in which it does not pressure the recording sheets, by the control cam. The return lever 22 is disposed in the position in which it keeps the recording sheet entrance blocked to prevent the recording sheets from entering deeper into the recording apparatus. As the operation for feeding the recording sheets into the recording apparatus begins, first, the separation roller 241 is placed in contact with the feed roller 28 by the motor. Then, the return lever 22 is released, and the pressure plate 21 is placed in contact with the feed roller 28, readying the sheet feeding portion 2 for the actual sheet feeding operation.

As a plurality of recording sheets are sent out of the feeder tray, their advance is regulated by a preliminary sheet separating portion 201 so that only a predetermined number of recording sheets are allowed to reach the nip between the feed roller 28 and separation roller 241. As they reach the nip, only the topmost sheet is separated from the rest, and is further conveyed. Meanwhile, as the predetermined number of the recording sheets reach the nip, the pressure plate 21 and separation roller 241 are allowed to moved back to their designated standby positions, by the rotation of the pressure plate cam and control cam, respectively. As for the return lever 22, it is moved back to its standby position, or the position in which it remains when no recording sheet is fed, by the rotation of the control cam. As the return lever 22 returns to its standby position, the rest of the predetermined number of recording sheets having reached the nip between the feed roller 28 and separation roller 241 are moved back to their designated standby positions in the feed tray, by the movement of the return lever 22.

Sheet Conveying Portion: The sheet conveying portion 3 is attached to a chassis 11 formed of metallic plate. It is provided with a conveyance roller 36 for conveying recording sheets, and a PE (paper end) sensor 32 for detecting the leading and tailing ends of each recording sheet. The conveyance roller 36 is a metallic shaft, the peripheral surface of which is coated with fine ceramic particles, and is borne by its lengthwise ends, by a pair of bearings 38 attached to the chassis 11. In order to ensure that the recording sheets are reliably conveyed, a conveyance roller tension spring is disposed between each bearing 38 and conveyance roller 36, applying thereby a predetermined amount of load to the conveyance roller 36.

The sheet conveying portion 3 is provided with a plurality of pinch rollers 37, which are disposed in contact with the peripheral surface of the conveyance roller 36. The pinch rollers 37 are rotated by the rotation of the conveyance roller 36. They are supported by a pinch roller holder 30, which is kept pressured by pinch roller springs 31 to keep the pinch rollers 37 pressured against the conveyance roller 36 to keep each recording sheet upon the peripheral surface of the conveyance roller 36 so that the force for conveying the recording sheet is generated. The shaft portion of the pinch roller holder 30 is borne by the bearings attached to the chassis 11 to pivotally support the pinch roller holder 30. The sheet conveying portion 3 is also provided with the combination of a guide flapper 33 and a platen 34, which is disposed at the entrance of the sheet conveying portion 3 to which the recording sheets are conveyed. Further, the sheet conveying portion 3 is provided with a PE sensor lever 321, which is attached to the pinch roller holder 30 to transmit the detection of the leading and trailing ends of each recording sheet. The platen 34 is attached to the chassis 11, being thereby accurately positioned. The guide flapper 33 is rotatable about the axis of the bearing portion 331, which bears the shaft portion of the conveyance roller 36. The guide flapper 33 positions itself as it comes into contact with the chassis 11.

As each recording sheet reaches the sheet conveying portion 3, it is conveyed to the nip between the conveyance roller 36 and pinch rollers 37 while being guided by the pinch roller holder 30 and guide flapper 33. While each recording sheet is conveyed to the nip, its leading end is detected by the PE sensor lever 321, and the detection of the leading end by the PE sensor lever 321 triggers the computation of the recording start position on the recording sheet. The recording sheet is conveyed along the platen 34 by the rotation of the pair of conveyance rollers 36 and 37 caused by the conveyance motor 35. The sheet guiding surface of the platen 34 is provided with a plurality of ribs. The plane which coincides with the tops of these ribs constitutes the referential surface for controlling the gap between the recording means 7 and recording sheet. The ribs also work in combination with the sheet discharging portion 4 to prevent the recording sheet from becoming wavy.

As for the driving of the conveyance roller 36, the rotational force from the conveyance motor 35, which is a DC motor, is transmitted to a pulley 361 solidly attached to the shaft of the conveyance roller 36, through a timing belt 351, to drive the conveyance roller 36. To the shaft of the conveyance roller 36, a code wheel 362 is attached, which is provided with a plurality of markings, the pitch of which is in the range of 150-300 1pi, and which is for detecting the distance by which the recording sheet is conveyed by the conveyance roller 36. Also to the chassis 11, an encoder sensor 363 for reading the markings of the code wheel 362 is attached.

On the downstream side of the conveyance roller 36 in terms of the recording sheet conveyance direction, the recording means 7 (recording head) which records images according to image formation data is disposed. In this embodiment, the recording means 7 is mounted on a carriage 50 which is movable in a shuttling manner. The recording portion 5 (carriage portion) comprises the carriage 50, and the recording means 7 mounted thereon. In this embodiment, an ink jet recording means to which a plurality of individual ink containers 71 different in the type (color, for example) of the ink they store are replaceably attached is employed as the recording means 7. The recording means 7 comprises heaters or the like, being enabled to apply heat to ink. As heat is applied to ink, ink is caused to boil in the so-called film boiling fashion. As a result, ink is ejected through the ejection orifices (nozzles) of the recording means 7 onto the recording sheet (recording medium) by the changes in pressure resulting from the bubble growth caused by the film boiling, and the subsequent bubble contraction. Thus, an image can be recorded on the recording sheet by controlling the ink ejection so that ink is ejected according to the recording data.

Recording Portion (Carriage Portion): The carriage portion 5 as the recording portion comprises the carriage 50 movable in the shuttling fashion, and the recording means 7 (recording head) mounted on the carriage 50. The carriage 50 is supported by the combination of a guide shaft 52 and a guide rail 111, being enabled to move in the shuttling fashion on the guide shaft 52 and guide rail 111 by being guided by the shaft 52 and rail 111. The guide shaft 52 is for guiding the carriage 50 in the primary direction, which is intersectional to the direction in which the recording sheet is conveyed. The guide rail 111 is given the function of supporting the carriage 50 by the rear end to keep the gap between the recording means 7 and recording sheet at a predetermined value. The guide shaft 52 is attached to the chassis 11, whereas the guide rail 111 is an integral part of the chassis 11.

The carriage 50 is driven by a carriage motor 54 attached to the chassis 11, through a timing belt 541. The timing belt 541 is wrapped around an idler pulley 542, being thereby given a predetermined amount of tension. The timing belt 541 is connected to the carriage 50 with the interposition of a dumper formed of rubber or the like substance, in order to reduce the image forming apparatus in terms of image anomaly by preventing the vibrations from the carriage motor 54 or the like from being transmitted to the carriage 50. The code strip 561 for detecting the position of the carriage 50 is disposed in parallel to the timing belt 541. The code strip 561 is provided with markings, the pitch of which is in the range of 150-300 1pi. The position of the carriage 50 is detected by reading the markings on the code strip 561 by the encoder sensor 56 with which the carriage substrate on the carriage 50 is provided.

The carriage substrate is also provided with a contact for establishing electrical connection between the carriage substrate and recording means 7. To the carriage 50, a flexible substrate 57 for transmitting recording signals from the electrical substrate 9 of the recording apparatus to the recording means 7 is attached. In order to precisely fix the recording means 7 to the predetermined area on the carriage 50, the carriage 50 is provided with a positioning stopper portion, and a pressing means 511 for keeping the recording means 7 pressed against the stopper portion to keep the recording means 7 precisely positioned relative to the carriage 50. The pressing means 511 is attached to a head set lever 51, which is structured so that it can be pivoted to apply pressure to the pressing means 511 (which presses recording means 7). The guide shaft 52 is provided with a pair of eccentric cams 521, which are fixed to the lengthwise ends 58 thereof, one for one. Thus, the guide shaft 52 can be vertically moved by transmitting the driving force to the eccentric cams 521 through a gear train, by the main cam of the recovery unit 6. By vertically moving the guide shaft 52, the carriage 50 can be vertically moved to keep the optimum amount of gap between the recording means 7 and a recording sheet, regardless of the thickness of the recording sheet.

To the carriage 50, a registration adjustment sensor 59 is attached, which is for automatically adjusting the positional relationship between the recording means 7 (carriage 50) and recording sheet, according to the positional deviation of the dots formed on the recording sheet by the ink droplets ejected from the recording means 7. The sensor 59 is a light sensor of the reflection type, and is enabled to output an optimum registration adjustment value by projecting a beam of light from its light emitting element onto the pattern of the recorded image on the recording sheet, and catching the light reflected by the predetermined pattern. With the employment of the above described structural arrangement, an image is formed on a recording sheet in the following manner: A recording sheet is conveyed by the pair of rollers 36 and 37 to the image formation position (in terms of recording sheet conveyance direction) in which the recording means 7 aligns with the recording line (section) along which recording is made. Then, the recording means 7 is aligned with the image formation position (in terms of direction perpendicular to recording sheet conveyance direction) by moving the carriage 50 by the carriage motor 54. Then, the recording means 7 is made to eject ink by the video signals sent from the electrical circuit 9, toward the recording sheet. As a result an image is formed on the recording sheet.

Sheet Discharging Portion: The sheet discharging portion comprises: a pair of sheet discharging rollers 40 and 41 (which hereinafter will be referred to discharge rollers); a spur 42 having a plurality of rowels, which are kept in contact with the peripheral surfaces of the discharge rollers 40 and 41 with the application of a predetermined amount of pressure, and are rotatable by the rotation of the discharge rollers 40 and 41; and a gear train for transmitting the driving force from the conveyance roller 36 to the discharge roller 40 and 41. The discharge rollers 40 and 41 are attached to the platen 34. The discharge roller 40, that is, the upstream discharge roller in terms of the recording sheet conveyance direction, comprises a metallic shaft, and a plurality of member formed of rubber and attached to the peripheral surface of the metallic shaft. As the driving force from the conveyance roller 36 is transmitted to the discharge roller 40 through an idler gear, the discharge rollers 40 and 41 both are rotationally driven at the same time. The discharge roller 41 disposed downstream of the discharge roller 40 comprises a resinous shaft, and a plurality of elastic members, formed of elastomer, attached to the resinous shaft. As for the transmission of the driving force from the discharge roller 40 to the discharge roller 41, the driving force is transmitted through an idler gear.

The spur 42 comprises the plurality of rowels formed of SUS or the like material, and a resinous portion which supports the rowels. The plurality of rowels and the resinous portion are integrally formed. The spur 42 is pivotally supported by a spur holder 43. More specifically, it is attached to the spur holder 43 with the use of a spur spring 44 (which is a coil spring wound in the form of a rod), being thereby kept pressed upon the discharge rollers 40 and 41. The spur 42 is provided with two types of rowels: the type which is disposed so that it coincides in position with one of the rubbery members of the discharge roller 40, or one of the elastic portions of the discharge roller 41, and primarily coordinates with the discharge rollers 40 and 41 to generate the force for conveying the recording sheet, and the type which coincides in position with one of the intervals of the rubbery portions of the discharge roller 40, or one of the intervals of the elastic portions of the discharge roller 41, and functions primarily to prevent the recording sheet from floating.

Between the discharge rollers 40 and 41, a sheet edge supporter is disposed, which raises the lateral edge portions of the recording sheet to prevent the problem that an image on the first surface of the recording sheet is damaged by the spinning of the discharge roller 40 and/or discharge roller 41, which occurs while the image is in contact with the rollers. The sheet supporter comprises a resinous member, to the tip of which a roller is attached, and a supporter spring. It is structured so that the roller is kept pressed upon the recording sheet, with the generation of a predetermined amount of pressure between the roller and recording sheet, by pressing the resinous member with the sheet supporter spring. With the employment of the above described structural arrangement, a recording sheet can be held so that it is stiffened as its lateral edges are raised.

As will be evident from the above description of the sheet discharging portion 4, after the formation of an image on the recording sheet in the recording portion 5, the recording sheet is further conveyed and discharged into a delivery tray 46 by being pinched by the discharge roller 41 and spur 42. The delivery tray 46 is structured so that it can be stored in a front cover; it is to be pulled out for a recording operation. In order to ensure that as the recording sheets are discharged into the delivery tray, they are satisfactorily accumulated in the delivery tray, and also, to prevent the recorded surface of the recording sheet from being rubbed against another recording sheet, the delivery tray is shaped so that its edge opposite from its base is slightly higher than the base, and also, so that its lateral edges are slightly higher than its center line in terms of the direction perpendicular to the sheet delivery direction.

Sheet Turning Portion (Two-sided Recording Mode Path): Referring to FIGS. 3 and 4, the sheet turning portion 8 (two-sided recording mode path), which is a part of the recording sheet conveying portion as is the sheet conveying portion 3, is a portion for making it possible to record on the reverse side of a recording sheet immediately after the completion of the recording on one of the two recording surfaces of the recording sheet. In the front side of the bottom portion of the main assembly of the image forming apparatus, is a cassette 81 in which recording sheets are mounted. The recording sheet turning portion 8 comprises a feed roller 821 for drawing out the recording sheets in the cassette 81 while separating them. The cassette 81 is provided with a pressure plate 822 for placing the recording sheets layered in the cassette 81, in contact with the feed roller 821. The recording sheet turning portion 8 comprises: the feed roller 821 for drawing recording sheets out of the cassette 81 and feeding into the main assembly of the image forming apparatus; a separation roller 831 for separating recording sheets one by one; a return lever 824 for returning the recording sheets other than the topmost sheet, back into their designated standby positions, or the original positions into which they are layered, in the cassette 81; the pressure plate 822 for pressing the recording sheets upon the feed roller 821; a controlling means for controlling the process of pressing the pressure plate 822 against the feed roller 821 or moving the pressure plate 822 in the direction opposite to the feed roller 821; a base 84, to which the preceding components are attached; etc. The cassette 81 is structured so that it can be adjusted in size (two sizes) according to the size of the recording sheet used for image formation. That is, when using recording sheets of the small size, or when the cassette 8 is not used, the cassette can be reduced in size so that it can be stored in the housing 9 of the main assembly of the image forming apparatus.

The feed roller 821 is in the form of a rod, and its cross section is roughly semicircular. The feed roller 821 is provided with a separation rubber roller 281, which is positioned near the recording sheet positioning reference, and by which recording sheets are fed and further conveyed. The feed roller 821 is driven by the force transmitted from a U-turn path conveyance motor 85 through a driving force transmission gear 851 and a planetary gear 852. The motor 85, and gears and 852 belong to the sheet turning portion 8. The pressure plate 822 is provided with a movable side cover 827, which regulates the recording sheets in their positions relative to the cassette 81 in which they have been stored in layers. The pressure plate 822 is supported in such a manner that it can be pivoted about a shaft attached to the cassette 81, and is kept pressured against the feed roller 821 by a pressure controlling means, which comprises a pressure plate spring 828 disposed between the pressure plate 822 and the base 84. Further, the pressure plate 822 is provided with a separation sheet 829, which is for preventing the plurality of top recording sheets in the cassette 81 from being conveyed together. The separation sheet 829 is attached to the area of the pressure plate 822, which opposes the feeder roller 821. The separation sheet 829 is formed of a material, such as an artificial leather, which is substantial in friction coefficient. The pressure plate 822 is moved toward, or away from, the feed roller 821, by a pressure plate cam.

To the base 84 of the sheet turning portion 8, a separation roller holder is rotatably attached, which axially holds the separation roller 831 for separating the recording sheets one by one, allowing thereby the separation roller 831 to about a rotational shaft. The separation roller holder is kept pressured by the separation roller spring in the direction to place the separation roller 831 in contact with the feed roller 821. The separation roller 831 is provided with a spring clutch, which allows the portion of the spring 834, to which the separation roller 831 is attached, to rotate as the load which applies to the separation roller 831 exceeds a predetermined value. The separation roller 831 is moved toward, or away from, the feed roller 821 by the combination of a separation roller release shaft and a control cam. The positions of the pressure plate 822, return lever 824, separation roller 831, etc., are detected by a U-turn path sensor with which the sheet turning portion 8 is provided. The return lever 824 for returning the recording sheets to their designated standby positions, into which they were placed in layers, is rotatably attached to the base 84 of the sheet turning portion 8, and is kept pressured by a return lever spring toward the direction in which the lever 22 return as it is released. In order to return the recording sheets, the return lever 824 is pivoted by a control cam.

Normally, when the recording apparatus is on standby, the pressure plate 822 is kept in the position in which it does not pressure the recording sheets, by the pressure plate cam, and the separation roller 831 is kept in the position, in which it does not pressure the recording sheets, by the control cam. As for the return lever 824, it is in the position into which it is returned to return the recording sheets to their designated standby positions in the cassette 81, into which they were placed in layers. It is disposed in the position in which it blocks the recording sheet entrance to prevent the recording sheets from entering deeper into the recording apparatus. As the operation for feeding the recording sheets into the recording apparatus begins, first, the separation roller 831 is placed in contact with the feed roller 821 by the force from the motor. Then, the return lever 824 is released, and the pressure plate 822 is placed in contact with the feed roller 28, readying the sheet feeding portion for the actual sheet feeding operation.

The movement of the recording sheets is regulated by a pre-regulating means with which the base 84 is provided. That is, only a top few of the recording sheets are allowed to reach the nip between the feed roller 821 and separation roller 831. As they reach the nip, the topmost sheet is separated from the rest, and only the topmost sheet is further conveyed by the feed roller 821. Meanwhile, as the top few of the recording sheets reach the nip, the pressure plate 822 and separation roller 831 are allowed to return to their standby positions, by the rotation of the pressure plate cam and control cam, respectively. As for the return lever 824, it is allowed to move back to its standby position, or the position in which it remains when no recording sheet is fed. As the return lever 824 returns to its standby position, the rest of the top few of the recording sheets having reached the nip between the feed roller 821 and separation roller 831 are moved back to their designated standby positions in the cassette 81. In order to reverse the direction in which a recording sheet is conveyed (in order to make recording sheet U-turn), the sheet conveying portion is provided with the sheet turning portion 8 comprising a pair of intermediate rollers 86 and 87 (first and second intermediate rollers), which are disposed at two different points of the sheet turning portion 8. Further, the sheet turning portion 8 is provided with a pair of pinch rollers 861 and 871, which are kept pressed upon the intermediate rollers 86 and 87, respectively.

Each of these intermediate rollers 86 and 87 comprises a metallic core, and four to six EPDM pieces (hardness of which is 40-80 degree in rubber hardness scale) attached to the different points of the metallic core, one for one. The pinch rollers 861 and 871 for pinching a recording sheet in coordination with these EPDM pieces are disposed in the position in which they oppose the EPDM pieces. Each of the pinch rollers 861 and 871 are attached to a spring-loaded shaft, being thereby kept pressed upon the intermediate rollers 86 and 87. In order to form the recording sheet conveyance path of the sheet turning portion 8, the sheet conveying portion is provided with an inner guide 881 for providing the sheet turning portion 8 with the inward surface, and an outer guide 882 for providing the sheet turning portion 8 with the outward surface.

After being fed (separated and conveyed) into the main assembly of the image forming apparatus, a recording sheet is introduced into the U-turn path. Then, as it reaches the nip of the first roller pair, that is, the first intermediate roller 86 and first pinch roller 861, the pressure plate cam is rotated to allow the pressure plate 822 to return to its standby position; the control cam is rotated to allow the separation roller 831 and return lever 824 to return to their standby positions. As a result, the rest of the top few of the recording sheets having reached the nip between the feed roller 821 and separation roller 831 are moved back to their designated standby positions in the cassette 81. On the downstream side of the first pair of rollers 86 and 861, the second pair of rollers, that is, the second intermediate roller 87 and second pinch roller 871, is disposed. That is, in order to reverse the direction in which a recording sheet is conveyed (in order to make recording sheet U-turn), the sheet turning portion 8 is provided with the pair of intermediate rollers 86 and 87, which are disposed at two different points of the U-turn path of the sheet turning portion 8. Further, the U-turn path is provided with the pair of pinch rollers 861 and 871, which are kept pressed upon the intermediate rollers 86 and 87, respectively.

The point at which the sheet conveyance path (feed- and conveyance path) and U-turn path of the sheet reversing portion 8 merge with each other is provided with a pivotable flapper 883, ensuring that a recording sheet is smoothly moved between the two sheet paths. As the leading end of a recording sheet having been fed from the sheet feeding portion 2 or the sheet turning portion 8 reaches the area between the conveyance roller 36 and pinch roller 37, it comes into contact with the nip formed by the conveyance roller 36 and pinch roller 37 which are being kept stationary. As a result, the recording sheet is slightly bent, correcting itself in attitude; in other words, the operation for precisely positioning the leading edge (head) of a recording sheet is complete. Thereafter, the recording sheet is conveyed by the conveyance roller 36 and pinch roller 37 in the positive direction (in which sheet is to be discharged), while recording is made on the recording sheet by the recording means 7. After the recording of an image on the top surface (first surface in this embodiment) of the recording sheet, the recording sheet is conveyed past the nip between the conveyance roller 36 and pinch roller 37.

When the image forming apparatus is in the two-sided recording mode, that is, the mode in which recording is made also on the second surface, that is, the reverse surface, of the recording sheet, immediately after the recording of the first surface, the trailing edge of the recording sheet, across the first surface of which an image has just been recorded, is made to be pinched again by the combination of the conveyance roller 36 and pinch roller 37. More specifically, first, the pinch roller 37 is moved upward (separated upward from conveyance roller 36) by a pinch roller elevating mechanism 884. Then, the recording sheet is moved backward by the discharge rollers 40 and 41 while the pinch roller 37 remains separated upward from the conveyance roller 36. Thereafter, the pinch roller 37 is lowered. Therefore, the recording sheet is smoothly pinched between the conveyance roller 36 and pinch roller 37. Then, the conveyance roller 36 is rotated in reverse. As a result, the recording sheet remaining pinched between the conveyance roller 36 and 37 is sent back into the main assembly of the recording apparatus. Then, the recording sheet is guided into the sheet turning portion 8, by the pivotable flapper 883 having been pivoted to the side where it guides the recording sheet into the sheet turning portion 8.

Having been sent into the sheet turning portion 8, the recording sheet is pinched by the combination of a two-sided recording mode roller 891 and a pinch roller 892, being thereby conveyed further while being guided by the two-sided recording mode inner guide 881 (guiding member), etc. As shown in the drawings, the sheet path in the sheet turning portion 8 can be roughly divided into two sections: a section extending from the flapper 883 and having a predetermined length, and an actual sheet turning section, that is, the U-turn path extending from the cassette 81 and comprising the first and second intermediate rollers 86 and 87. Each of the intermediate rollers 86 and 87 comprises a metallic core, and 4-6 EPDM pieces attached to the metallic core with the provision of predetermined intervals among the EPDM pieces. The hardness of the EPDM pieces is in the range of 40-80 degrees in terms of the hardness scale for rubber. The sheet turning section (U-turn path) is also provided with a pair of pinch rollers 861 and 871, which are disposed in a manner of opposing the EPDM pieces so that the recording sheet is pinched between the EPDM pieces and the pinch rollers 861 and 871. Each of the pinch rollers 861 and 871 is supported by a shaft borne by a set of springs, being thereby kept pressured against the corresponding pinch roller. In order to form the U-turn path, the inner guide 881 for providing the U-turn path with the inward surface, and the outer guide 882 for providing the U-turn path with the outward surface.

As the recording sheet, on the first surface of which recording has just been made, is conveyed through the above described U-turn path, it is placed upside down, that is, it is turned so that its second surface (surface opposite to first surface) faces upward of the drawings. The turned recording sheet is sent again into the nip formed by the conveyance roller 36 and pinch roller 37, as the first and second intermediate rollers 86 and 87 are driven. Then, while the recording sheet is conveyed through the recording portion by the rotation of the conveyance roller 36, recording is made across the second surface of the recording sheet by the recording means 7.

Figure 5:
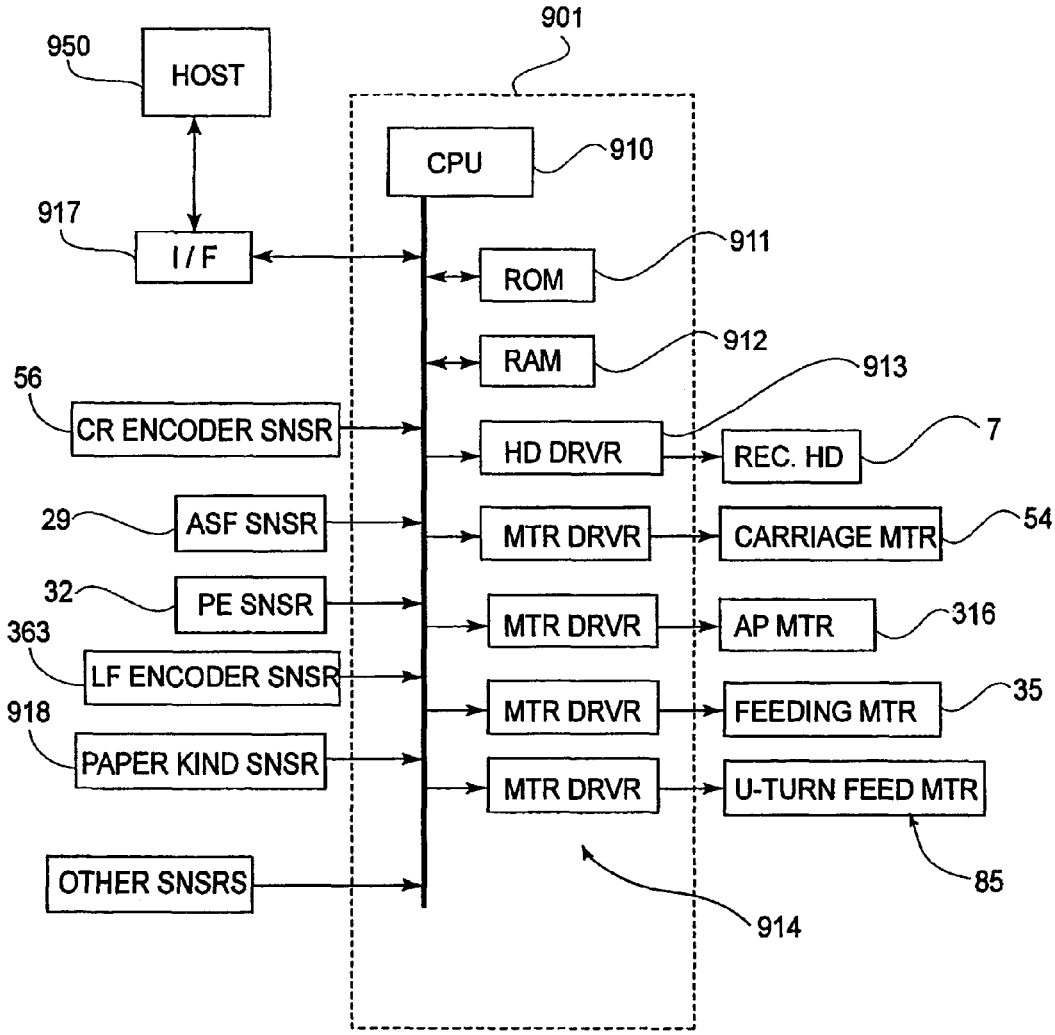
FIG. 5 is a block diagram of the control of the recording apparatus shown in FIG. 1.

FIG. 5 is a block diagram showing the overall control of the recording apparatus in the two-sided recording mode.

A control circuit 901 comprises: a CPU 910 which controls the image forming apparatus in the two-sided recording mode, and also, outputs various control signals; a ROM 911 storing the control data having been written into the ROM 911; a RAM 912 in which the recording data or the like are developed; etc.

Designated by a referential symbol 913 is a head driver for driving the recording head 7, and designated by a referential symbol 914 is each of a plurality of motor drivers for driving the carriage motor 54, AP motor 316 for feeding recording sheets, motor 35 for recording sheet conveyance, motor for conveying recording sheet through the sheet turning portion 8, one for one. Designated by a referential symbol 917 is an interface through which data are transmitted or received between the recording apparatus and a host apparatus 950 such as a computer, a digital camera, etc.

Described next will be the recording operation, inclusive of the step (sequence) in which a skewed recording sheet is corrected in attitude in terms of the recording sheet conveyance direction, carried out by the recording apparatus in this embodiment of the present invention when the apparatus is in the two-sided recording mode. This sequence in which a skewed recording sheet is corrected in attitude is such a sequence that the leading end of the recording sheet, in terms of the recording sheet conveyance direction is jogged against the nip formed by the pair of rollers (driving roller and following roller), which are being kept stationary, in order to regulate the recording sheet not only in the position of its leading edge, but also, in attitude, by utilizing the resiliency of the recording sheet.

After being fed into the recording portion from the sheet feeding portion 2 or the sheet turning portion 8, the recording sheet is conveyed by the sheet conveying portion 3, and as the recording sheet is intermittently conveyed, the recording portion 5 (carriage portion) made up of the carriage 50, which can be moved in a shuttling fashion, and the recording means 7 mounted on the carriage 50, is made to scan the recording sheet in the oscillatory fashion, in the direction intersectional to the recording sheet conveyance direction, recording thereby an image section by section.

The operation carried out by the recording apparatus when the apparatus is in the two-sided recording mode is as follows: After the completion of the formation of an image on one (first) of the two surfaces of a recording sheet, the recording sheet is stopped in the sheet discharging portion 4 while being discharged. Then, it is sent into the sheet turning portion 8 by the reverse driving of the sheet conveying portion 3. The sheet path of the sheet turning portion 8 comprises two portions: a portion which extends, in terms of the sheet conveyance direction, from the flapper 883 to a two-sided recording mode flapper 895 switchable in position between the position in which it is placed for the two-sided recording mode and the position in which it is placed for allowing recording sheets to be drawn out of the cassette 81; and a portion which constitutes the U-turn portion (sheet path portion which actually turns recording sheet), which extends from the flapper 895 back to the flapper 883. Thus, as the recording sheet is conveyed through the U-turn portion of the sheet turning portion 8, comprising the intermediate rollers 86 and 87, it is placed upside down. The turned recording sheet is pinched again by the combination of the conveyance roller 36 and pinch roller 37, being thereby further conveyed through the recording portion, and while the recording sheet is conveyed through the recording portion, an image is formed on the second surface of the recording sheet.

Generally, when a recording sheet, which does not have such a surface as a coated surface, that is likely to sustain rubber marks attributable to the spinning of a sheet conveying roller (conveyance roller or the like), is used for image formation, the leading end of a recording sheet jogged against the nip between the conveyance roller 36 and pinch roller 37 which are being kept stationary, in order to correct the recording sheet in attitude (to correctly position leading edge (head) of recording sheet), regardless of whether an image is to be formed on the first surface of the recording sheet or the second surface.

However, carrying out the above described recording sequence (more specifically, the above described sequence for correcting a recording sheet in attitude) to form an image on the second surface, as well as, the first surface, of a recording sheet having such surfaces as a coated surface, that are likely to sustain the rubber marks (roller marks) if the recording sheet is subjected to the above described sequence, is problematic in that the first surface of the recording sheet (or image recorded thereon) will sustain roller marks. The reason for this problem is as follows: While the recording sheet, on the first surface of which an image has just been recorded, is conveyed through the sheet turning portion 8 in order to record an image on the second surface of the recording sheet, the first surface comes, and remains, in contact with the intermediate rollers 86 and 87 of the U-turn path portion of the sheet turning portion 8. Thus, as the leading end of the recording sheet is jogged against the nip between the conveyance roller 36 and pinch roller 37 to correct in attitude the recording sheet (which is possibly askew), the intermediate rollers 86 and 87 spin in contact with (and therefore rubbing) the first surface which has just been wetted and swollen by the recording liquid used for recording an image on the first surface.

In this embodiment, therefore, the recording apparatus is structured as follows: When the apparatus is in the two-sided printing mode and an image is recorded on the first surface of a recording sheet having recording surfaces, such as a coated surface, that are likely to sustain roller marks when the sequence for correcting a recording sheet in attitude is carried out, in other words, when the first surface of the recording sheet is going to face the recording means, the sequence for correcting a skewed recording sheet in attitude by jogging the recording sheet in the direction in which it is conveyed for the actual image formation, is carried, whereas when an image is recorded on the second surface, or the surface opposite to the first surface, of the recording sheet, that is, when the second surface is going to face the recording means, or in the like situation, the sequence for correcting a recording sheet in attitude by jogging the recording sheet in the direction in which it is conveyed for the actual image formation is not carried out as it is when an image is formed on the first surface.

More specifically, in this embodiment, the operation carried out by the recording apparatus when recording is made on both surfaces of such a recording sheet as a coated sheet, which are likely to sustain roller marks, is as follows: When the first surface of this recording sheet is going to face the recording means, that is, when recording is to be made on the first surface of the recording sheet, the recording sheet is conveyed by a predetermined distance (for example, by rotationally driving conveyance roller 36 and pinch roller 37 by predetermined amount) without carrying out the sequence for jogging a recording sheet so that its leading end is pushed against the nip between the conveyance roller 36 and pinch roller 37, which are being kept stationary, as the recording sheet is conveyed from the sheet feeding portion 2 to the sheet conveying portion 3. Thereafter, the conveyance roller 36 is driven in reverse to return the leading end (trailing end in terms of current recording medium conveyance direction) of the recording sheet to the nip between the conveyance roller 36 and pinch roller 37, with the combination of the feed roller 28 and separation roller 241, or the first and second intermediate rollers 86 and 87, kept stationary, in order to push the leading end (in terms of current recording sheet conveyance direction) against the nip between the feed roller 28 and separation roller 241, the nip between the intermediate roller 86 and its counterpart, or the nip between the intermediate roller 87 and its counterpart, so that the recording sheet is corrected in attitude by its own resiliency (leading edge (head) of recording sheet is corrected in attitude and accurately positioned for image formation).

After the sequence of correcting a skewed recording sheet in attitude is carried out as described above, with the first surface of the recording sheet facing in the direction to oppose the recording means in the recording portion, recording is made on the first surface of the recording sheet. After the completion of the formation of an image on the first surface, the recording sheet is introduced by the sheet conveying portion 3 (conveyance roller 36) into the sheet turning portion 8. Thus, the edge of the recording sheet, which was the leading edge while recording was made on the first surface, becomes the leading edge. As the recording sheet is conveyed through the sheet turning portion 8 by the intermediate rollers 86 and 87, it is turned over (made to U-turn). Thereafter, the turned recording sheet is conveyed toward the recording portion to record an image on the second surface. During this conveyance of the recording sheet toward the recording portion, the sequence carried out for correcting the recording sheet in attitude (sequence of jogging recording sheet so that leading end of recording sheet is pushed against nip between conveyance roller 36 and pinch roller 37 to correcting recording sheet in attitude, and also, so that the leading edge (head) is precisely positioning) when an image is recorded on the first surface of the recording sheet, is not carried out. In other words, when an image is formed on the second surface of the recording sheet, the sequence for correcting a skewed recording sheet in attitude is not carried out.

With a recording sheet conveyed as described above, the problem that as a recording sheet is jogged against the nip of the conveyance roller 36 and pinch roller 37, which are being kept stationary, some of the rollers other than the conveyance roller 36 and 37 spin on the recording sheet, more specifically, the problem that the intermediate rollers 86 and 87 spin on the surface of the recording sheet, on which an image was formed first, can be eliminated. Therefore, the occurrences of the roller marks, traceable to the spinning of the intermediate rollers 86 and 87, on the first recording surface of the recording sheet, can be completely eliminated, or reduced in frequency and/or magnitude. When the image forming apparatus is in the automatic two-sided recording mode, the length of time from the completion of the recording on the first surface to the starting of the recording on the second surface is rather short. Therefore, the occurrences of the above described roller marks are likely to be exacerbated in their ill effects. However, in this embodiment, the image forming apparatus is structured to be controlled so that the sequence for correcting a skewed recording sheet in attitude is carried out when recording an image on the first surface of a recording sheet, but, it is not carried out when recording an image on the second surface. Therefore, even when recording on the second surface of such a recording sheet as a coated recording sheet, that is likely to sustain roller marks or the like, the occurrences of the problem that the recorded first surface sustains roller marks is very effectively reduced in frequency as well as magnitude, or can be completely eliminated. Therefore, the image forming apparatus is prevented from being reduced in image quality when it is in the two-sided recording mode.

In the above described embodiment of the present invention, the recording apparatus comprising: the recording portion 5 which records an image on a sheet of recording medium (recording sheet); conveying means 36 and 37 which convey a recording sheet through the recording portion 5; and recording sheet turning portion 8 which automatically turns a recording sheet, is structured to be controlled as follows. When it is in the two-sided recording mode, a recording sheet is turned over by the sheet turning portion 8 after the completion of the recording of an image on the first surface. Then, the recording sheet is returned to the recording portion through which recording is to be made on the second surface. Further, the conveying means comprises the conveyance roller 36 and the follower roller 37 which is rotated by the rotation of the roller 36, and is structured so that when an image is record on the second surface, the conveyance roller 36 contacts the first surface, and also, so that when a recording sheet is conveyed through the sheet turning portion 8 in order to record an image on the second surface of the recording sheet, the rollers 86 and 87 of the sheet turning portion 8 contacts the first surface.

When the above described recording apparatus is used to record an image on both surfaces of such a recording sheet having no such surface as a coated surface which sustains the rubber marks attributable to the recording sheet conveying rollers (conveyance roller or the like) when the sequence for of correcting a skewed recording sheet in attitude is carried out, the sequence for correcting a skewed recording sheet in attitude, that is, the sequence in which the leading end of a recording sheet is placed in contact with the nip between the conveyance roller 36 and follower roller 37, which are being kept stationary, and then, the recording sheet is pushed against the nip by the conveyance roller 28, or 86 and/or 87, which are on the upstream side of the rollers 36 and 37, in order to slightly bend the recording sheet to utilize the resiliency of the recording sheet to cause the recording sheet to correct itself in attitude, is carried out not only when recording is made on the first surface of the recording sheet, but also when recording on the second surface.

However, when the above described recording apparatus is used to record an image on both surfaces of such a recording sheet having such surfaces, as a coated surface, that are likely to sustain the rubber marks attributable to the recording sheet conveying rollers (conveyance roller or the like) when the sequence for correcting a skewed recording sheet in attitude is carried out, the apparatus is controlled in the following fashion: When recording on the first surface of the recording sheet, a recording sheet is conveyed a predetermined distance without jogging the recording sheet against the nip between the conveyance roller 36 and pinch roller 37. Then, the conveyance roller 36 is driven in reverse to return the leading end of the recording sheet to the nip between the conveyance roller 36 and pinch roller 37 while keeping stationary the combination of the feed roller 28 and separation roller 241, or the first and second intermediate rollers 86 and 87. Consequently the recording sheet is jogged against the nip between the feed roller 28 and separation roller 241, the nip between the intermediate roller 86 and pinch roller 861, or the nip between the intermediate roller 87 and pinch roller 871. As a result, the recording sheet is caused to correct itself in attitude by its own resiliency (not only is skewed recording sheet is corrected in attitude, but also, leading edge (head) of recording sheet is precisely positioned relative to recording portion). Whereas, when an image is recorded on the second surface, the sequence for correcting a skewed recording sheet in attitude is not carried out.

Figure 6:
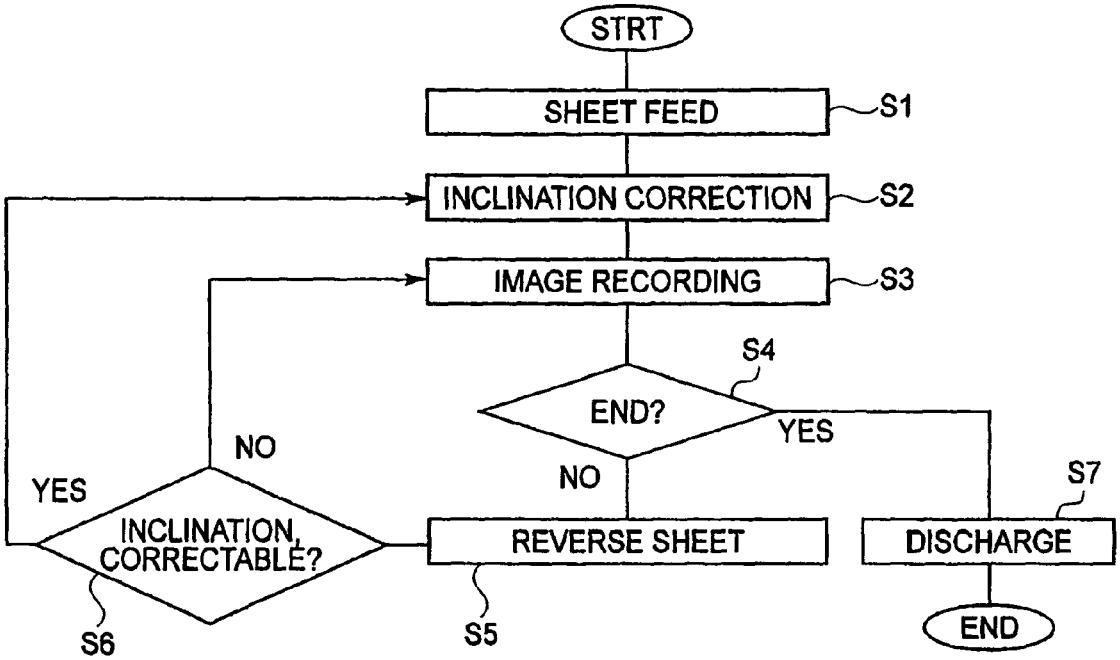

Next, referring to FIG. 6, which is a flowchart of the control of the recording apparatus in this embodiment, the recording operation of the apparatus will be described.

In Step S1, the feed roller 28 is driven by the AP motor 316 to feed a recording sheet, or the feed roller 821, intermediate rollers 86 and 87, are driven by the U-turn motor to feed a recording sheet from the cassette 81.

In Step S2, the AP motor 316 or U-turn motor is continuously driven until the recording sheet slightly bends after the leading of the recording sheet comes into contact with the nip between the conveyance roller 36 and pinch roller 37. As the recording sheet is jogged with its leading end of the recording sheet placed against the nip between the conveyance roller 36 and pinch roller 27, the recording sheet, which is possibly askew, is corrected in attitude.

In Step S3, the conveyance motor 35 is driven to send the recording sheet into the recording portion 5, in which an image is recorded on the recording sheet with the recording head 7 according to image formation data.

In Step S4, it is determined whether the intended recording operation has been completed, or recording is to be made also on the second surface of the recording sheet. When recording is to be made on the second surface, Step 5 is taken.

In Step S5, the discharge roller 40 and conveyance roller 36 are driven in reverse by the conveyance motor 35, conveying thereby the recording sheet in the opposite direction. Further, the guide flapper 883 is pivoted in the clockwise direction of FIG. 4, in order to guide the leading end of the recording sheet, in terms of the current recording sheet conveyance direction, into the two-sided recording mode path 80. Then, the two-sided recording mode roller 891, feed roller 821, and intermediate rollers 86 and 87 are driven by the U-turn motor, conveying thereby the recording sheet to the conveyance roller 36.

In Step S6, it is determined, based on the data regarding the type of the recording sheet, whether or not the surface of the recording sheet, which is in contact with the intermediate rollers 86 and 87, is of the type, such as the coated type, which is likely to sustain roller marks.

If it is determined that the surface of the recording sheet is of the type that is unlikely to sustain roller marks, in other words, if it is determined that carrying out the sequence for correcting a skewed recording sheet in attitude creates no problem, Step S2 is taken, in which the sequence is carried out. Then, Step S3 is taken to form an image on the recording sheet. Whereas, if it is determined that the surface of the recording sheet, which is in contact with the intermediate rollers 86 and 87, is of the type that is likely to sustain roller marks, the sequence for correcting a skewed recording sheet is not carried out. Instead, as the recording sheet is sent to the combination of the conveyance roller 36 and 37 by the intermediate rollers 86 and 87, it is pinched by the combination of the conveyance rollers 36 and 37, which are being rotated, being thereby further conveyed. Then, recording is made in Step S3.

If it is determined in Step S4 that the intended recording operation has been completed, Step S7 is taken, in which the recording sheet is discharged out of the main assembly of the recording apparatus through the discharging portion 4.

The above described control is carried out by the controlling means 901 of the recording apparatus, based on the data regarding recording sheet types. The data regarding recording sheet types are acquired by the controlling means, as the data are sent, along with the image formation data, from a host computer or the like. However, a recording apparatus may be provided with a mode selection switch and/or recording medium type selection switch (inputting means) so that whether or not the sequence for correcting a skewed recording sheet in attitude is to be carried out when recording on the first or second surface of the recording sheet, or which of the above described two sequences of correcting a skewed recording sheet in attitude is to be carried out, is determined according to the selected mode or recording medium type. Regarding the acquisition of the data regarding the recording sheet types, the recording sheet conveyance paths or sheet feeder tray of a recording apparatus may be provided with a sheet type sensor 918 in order to enable the controlling portion to determine (read) the type of a recording sheet while the recording sheet is conveyed to the recording portion 5, or while the recording sheet is in the feeder tray, respectively.

In the above, this embodiment of the present invention was described with reference to the recording apparatus comprising the sheet turning portion 8. However, the present invention is also applicable to a recording apparatus which does not have the sheet turning portion (portion for turning over recording sheet). Further, it is also applicable to a recording apparatus comprising the sheet turning portion 8, even when the sheet turning portion 8 is not used. Next, referring to FIG. 4, the image forming operation, which is carried out by the recording apparatus in this embodiment when the sheet turning portion is not used, will be described. As a recording sheet is fed from the sheet feeding portion 2 or cassette 81 of the sheet turning portion 8, it is conveyed by the sheet conveying portion 3 in the positive direction (leftward in drawing), while the carriage portion 5 carrying the recording means 7 is made to move in the oscillatory fashion, in the direction intersectional to the recording sheet conveyance direction, in a manner of scanning the recording sheet. As a result, an image is recorded on the first surface of the recording sheet. Thereafter, the recording sheet is manually turned over, and placed again in the sheet feeding portion 2 or the sheet turning portion 8 (cassette 81), in order to feed the recording sheet to the nip between the conveyance roller 36 and pinch roller 37 so that recording is made on the second surface of the recording sheet as it was on the first surface.

In comparison, when recording is made on a recording sheet which does not sustain rubber marks even when the sequence for correcting a skewed recording sheet in attitude is carried out, the recording apparatus is controlled so that the sequence for correcting a skewed recording sheet in attitude, more specifically, the sequence in which the recording sheet is jogged with its leading end of the recording sheet placed against the nip between the conveyance roller 86 and pinch roller 37, which are being kept stationary, to correct a skewed recording sheet in attitude, is carried out both when recording is made on the first surface of the recording sheet and when recording is made on the second surface. On the other hand, when a recording sheet, one of the surfaces of which is coated, is used as the recording medium, and the coated surface is the first surface on which an image is to be recorded, the following sequence for correcting a skewed recording sheet in attitude is carried out: The recording sheet is conveyed by a predetermined distance without carrying out the sequence for jogging the recording sheet so that its leading end is pushed against the nip between the conveyance roller 36 and pinch roller 37, which are being kept stationary. Then, the conveyance roller 36 is driven in reverse, with the feed roller 28 and separation roller 241 kept stationary, returning thereby the leading end of the recording sheet, in terms of the current recording sheet conveyance direction, to the nip between the conveyance roller 36 and pinch roller 37. Consequently, the leading end of the recording sheet is pushed against the nip between the feed roller 28 and separation roller 241, by the resiliency of the recording sheet. As a result, the recording sheet is corrected in attitude (not only is recording sheet is corrected in attitude, but also, its leading edge (head) is precisely positioned relative to image forming portion). Thereafter, that is, after the above described sequence for correcting a recording sheet in attitude is carried out, with the recording sheet positioned so that its first surface faces the recording means when the recording sheet is conveyed through the recording portion, an image is recorded on the first surface of the recording sheet.

Thereafter, the recording sheet is manually turned over, and is set in the sheet feeding portion 2 or cassette 81 to feed the recording sheet in order to record an image on the second surface of the recording sheet as it was on the first surface. While the recording sheet is conveyed to form an image on the second surface, the first surface is in contact with the separation roller 241 or second intermediate roller 87. Therefore, carrying out the sheet attitude correcting sequence causes the first surface to sustain roller marks. Thus, when the recording sheet is conveyed so that its second surface will face the recording means while it is conveyed in the recording portion (when forming image on second surface), an image is formed on the recording sheet without carrying out the above described recording sheet attitude correcting sequence. With the recording apparatus controlled as described above, the occurrences of the roller marks attributable to the spinning of the separation roller 241, or one or both of the intermediate rollers 86 and 87, can be eliminated or reduced in frequency as well as magnitude. As for the means for providing the control portion with the information regarding the type of the second surface of a recording sheet when manually turning over the recording sheet to form an image on the second surface thereof, the type may be selected, as necessary, in the printer driver window of the PC. The mechanical structure for allowing a recording sheet to be manually turned over to form an image on the second surface of the recording sheet, controlling means, functions thereof, and effects thereof, are the same as those for automatically recording an image on both surfaces of a recording sheet.

Also in the above, this embodiment was described with reference to the recording apparatus employing the recording method of the serial type, that is, the type in which a recording means is moved (in primary direction) relative to a recording sheet, as an object on which recording is to be made, in a manner to scan the recording sheet. However, the present invention is also applicable to a recording apparatus of the line recording type, that is, the type in which an image is recorded by moving a recording means of the line type, the length of which matches the entire width, or virtually the entire width, of a recording sheet, only in the secondary direction, in a manner to scan the recording sheet. The effects of such an application are the same as those in this embodiment. Moreover, not only is the present invention applicable to a recording apparatus employing a single recording means, but also, a color recording apparatus employing a plurality of recording means different in the color of the inks they use for recording, a gradation recording apparatus employing a plurality of recording means which are identical in the color of the inks they use for recording, but are different in density of the inks they use for recording, as well as a hybrid recording apparatus made up of the combination of the preceding recording apparatuses. The effects of such an application are the same as those achievable by the recording apparatus in this embodiment.

Further, regarding the structure of an ink jet recording apparatus to which the present invention is applicable, not only is the present invention applicable to an ink jet recording apparatus structured to employ an ink cartridge comprising a recording means and an ink container, which are integral, but also, to an ink jet recording apparatus structured to employ an ink cartridge comprising a recording means and an ink container, which are independent from each other, and are to be connected with the use of an ink supply tube or the like. In other words, the present invention is applicable to an ink jet recording apparatus regardless of the positioning and structures of the recording means and ink container of the ink cartridge employed by the ink jet recording apparatus, and the effects achievable by such an application are the same as those achievable by the apparatus in this embodiment. Further, regarding the ink ejecting means employed by an ink jet recording apparatus, not only is the present invention applicable to an ink jet recording apparatus employing the recording means of the type which uses thermal energy to eject ink, but also, an ink jet recording apparatus employing a recording means which uses electro-mechanical transducer such as piezoelectric elements or the like. However, the effects achievable when the present invention is applied to an ink jet recording apparatus which uses thermal energy exceed those achievable when it is applied to an ink jet recording apparatus which uses electro-mechanical energy, because the former can yield images which are higher in density and more precise.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 159661/2004 filed May 28, 2004 which is hereby incorporated by reference.

What is claimed is:

1. A recording apparatus comprising:

a recording portion for recording an image on a recording sheet;

a conveyance roller and a follower roller which is driven by said conveyance roller, for conveying the recording sheet through said recording portion, wherein said conveyance roller and said follower roller are the rollers closest to said recording portion upstream of said recording portion; and a reverse feeding portion for reversing, in a facing orientation, the recording sheet on a first side of which recording has been effected by said recording portion, and for feeding the recording sheet which has been reversed to said conveyance roller and said follower roller, wherein, in a double-sided recording operation, the recording sheet is conveyed for a predetermined distance by said conveyance roller and said follower roller, and said conveyance roller is then driven in reverse to return a trailing end (with respect to current conveying direction) of the recording sheet to a nip formed between the conveyance roller and the follower roller so that a sheet inclination rectifying operation is carried out by pushing a leading end of the recording sheet (with respect to current conveying direction) against a nip formed between a pair of rollers further upstream of said recording portion, before the recording is effected on the first side of the recording sheet, the recording sheet is conveyed by said conveyance roller to said reverse feeding portion, after the recording is effected on a the first side of the recording sheet by said recording portion, and the recording sheet received from the reverse feeding portion is conveyed by the pair of rollers further upstream of said recording portion and further conveyed to the recording portion by said conveyance roller and said follower roller, which are being rotated, without the sheet inclination rectifying operation, before the recording is effected on a second side of the recording sheet by said recording portion.

2. An apparatus according to claim 1, wherein the recording on the second side is effected after the recording on the first side is effected.

3. A apparatus according to claim 1 or 2, wherein, when the recording is effected on the second side, said conveyance roller contacts the first side of the recording sheet.

4. An apparatus according to claim 1 or 2, further comprising a U-turn feeding portion for inversing the recording sheet in its facing orientation, wherein the recording sheet is fed in said U-turn feeding portion, and a roller of said U-turn feeding portion contacts the first side of the recording sheet.

5. An apparatus according to claim 1 or 2, wherein the first side is a coated surface.

6. A recording apparatus comprising:

a recording portion for recording an image on a recording sheet;

feeding means for feeding the recording sheet to said recording portion when the recording is effected by said recording portion on a first side or a second side of the recording sheet, wherein said feeding means comprises rollers closest to said recording portion upstream of said recording portion;

a reverse feeding portion for inverting, in a facing orientation, the recording sheet on the first side of which recording has been effected by said recording portion, and for feeding the recording sheet to said feeding means; and control means for rectifying a sheet inclination by pushing a leading end of the recording sheet against a nip of said feeding means, which is kept stationary until the sheet inclination rectifying operation is completed, before the recording is effected on the first side of the recording sheet by said recording portion, conveying the recording sheet by said feeding means to said reverse feeding portion after the recording is effected on the first side of the recording sheet by said recording portion, and selectively effecting the sheet inclination rectifying operation, in response to information relating to a kind of the recording sheet, before the recording is effected on the second side of the recording sheet which has been inverted by said reverse feeding portion.

7. An apparatus according to claim 6, wherein said control means, when the recording is effected on the first side of the recording sheet, effects either a sheet inclination rectifying operation for rectifying the sheet inclination by pushing the leading end of the recording sheet against the nip of said feeding means, which is at rest until the sheet inclination rectifying operation is complete, and curving the recording sheet by a pair of rollers further upstream of said recording portion, or a sheet inclination rectifying operation for rectifying the sheet inclination by conveying, after conveying the recording sheet for a predetermined distance by said feeding means, the recording sheet backwardly until a leading end of the recording sheet (with respect to current conveying direction) is jogged against a nip formed between the pair of rollers further upstream of said recording portion, in response to information relating to the kind of the recording sheet.

8. An apparatus according to claim 7, wherein said control means acquires the information from a host computer.

9. An apparatus according to claim 7 or 8, further comprising inputting means for inputting the information relating to the kind of the recording sheet to said control means.

10. An apparatus according to claim 7 or 8, further comprising a paper sensor for sensing the information relating to the kind of the recording sheet from the recording sheet on which the recording is to be effected.

* * * * *